United States Patent [19]

Anderson

[11] Patent Number: 4,955,584

[45] Date of Patent: Sep. 11, 1990

[54] PUMP JACK

[76] Inventor: Carl Anderson, c/o Alum-A-Pole Corporation 2589 Richmond Terrace Industrial Bldgs, 9A&B, Staten Island, N.Y. 10303-0002

[21] Appl. No.: 326,326

[22] Filed: Mar. 21, 1989

[51] Int. Cl.[5] ..... A63B 27/00

[52] U.S. Cl. ..... 182/133; 254/106; 182/136

[58] Field of Search ..... 254/106; 182/133, 135, 182/136, 141

[56] References Cited

U.S. PATENT DOCUMENTS

| | | | |
|---|---|---|---|
| 4,008,785 | 2/1977 | Mugnaini | 182/133 |
| 4,411,335 | 10/1983 | Forrester | 182/178 |
| 4,463,828 | 8/1984 | Anderson | 182/136 |
| 4,499,967 | 2/1985 | Anderson | 182/145 |
| 4,549,633 | 10/1985 | Merritt | 182/135 |
| 4,597,471 | 7/1986 | Anderson | 182/145 |
| 4,747,468 | 5/1988 | Greenway | 182/133 |

*Primary Examiner*—J. J. Hartman

*Attorney, Agent, or Firm*—Helfgott & Karas

[57] ABSTRACT

A pump jack for traveling up and down a pole includes a frame member which supports a lower shackle having a front and a rear gripping rods applying a clamping force for gripping the pole. A pump arm pivotally supports and operates an upper shackle also having a front and a rear gripping rod for clamping the pole. The lower shackle has a single U-shaped yoke pivotally supported on and biased to a support arm to improve the leverage for operating the lower shackle. The upper shackle is provided with a freely rotatable roller mounted on the upper shackle so as to space the bitting front rod of the upper shackle from the pole to permit stepping up of the upper shackle. The usual tension springs on the upper shackle are eliminated to thereby permit less force needed for its operation.

29 Claims, 5 Drawing Sheets

PUMP JACK

BACKGROUND OF THE INVENTION

The present invention relates to scaffolding equipment, and more particularly to a pump jack adapted for traveling up and down a pole.

While working on elevated surfaces on a building it is necessary to erect a scaffolding in order to permit workers to stand at the elevation above the ground surface. Typically, in connection with the installation of siding on the exterior of a building, it has been customary to utilize for this purpose pump jacks which ride on vertical poles and support a platform on which the workers can stand. The worker stands on the platform and manipulates the pump jack by using his foot to pump the jack and thus raise it in a stepwise manner along the pole. To lower the pump jack, he depresses a release pedal and using a hand lever he rolls the pump jack down the pole.

The pump jacks of the foregoing type typically include a frame and an upper and lower shackle supported by the frame. The pump jack further includes a foot operated pump arm pivotally connected to the frame and adapted to operate the shackles in alternating relationship so as to cause the upper and lower shackles to alternately grip the pole as the weight of the worker shifts from the platform to the pump arm and then back. When the upper shackle grips the pole, depressing the pump arm steps up the frame relative to the pole. Then the weight of the worker standing on the scaffolding staging shifts so that the lower shackle grips the pole while the pump jack remains in place on the pole. However in lifting up the pump arm back again, the upper shackle moves up along the pole to a next position on the pole. In such manner each non-gripping shackle steps up the pole while the opposite shackle grips the pole. In order to ride the pump jack down the pole, the lower shackle is released from gripping the pole and the upper shackle is rolled down the pole by means of a handle provided on the pump jack.

Pump jacks of the type under consideration are disclosed in applicant's Pat. Nos. 4,382,488; 4,463,828; and 4,597,471.

Upper shackles in conventional pump jacks are formed of two substantially U-shaped members, pivotable with respect to each other. One U-shaped member is a yoke member and has two gripping rollers for engaging onto a pump jack pole for climbing up and down the pole. The second is a linkage member, pivotable on the pump arm of the pump jack and is biased relative to the yoke member by tension springs connected between the two members. The springs ensure that the upper shackle is tightened on the pole and also aids in releasing the yoke member from gripping onto the pole when the upper shackle is being stepped up along the pole. Because of the springs, however, in depressing the pump arm to step up the pump jack frame along the pole, the worker must not only exert a force to raise the frame, but must also exert a force to overcome the force of the springs. As a result such pumping makes it hard on the operator's foot.

The lower shackles of conventional pump jacks are also formed by two substantially U-shaped members which are pivoted together and are biased with respect to one another by tension springs. Lower shackles are typically used for temporarily gripping the pole while the upper shackle steps up along the pole. However, when the upper shackle is rolling down the pole, the lower shackle must be pushed forward away from the pole to avoid gripping of the pole. With the two U-shaped members, the yoke member is pivoted to the U-shaped linkage member and the linkage member is then pivotally secured to the pump jack frame in a scissor action. As a result, when pushing forward the lower shackle to release it from the pole, pressing forward on the yoke member requires a considerable effort because a great amount of leverage is required to disengage and retain the lower shackle from the pole. Additionally, because of this double U-member arrangement, the spacing of the front of the yoke member from the pole is minimal and often the yoke member may accidentally catch and regrip the pole thereby causing a problem in rolling down the pump jack along the pole.

Furthermore, with the double U-member arrangement, when releasing the lower shackle, the shackle moves in an arcuate path. This also causes the pump jack frame to arcuate whereby a momentary sensation of the jack dropping downward has resulted. This causes fear to the inexperienced user and even to the experienced worker operating at great heights it causes great concern.

Accordingly, while conventional pump jacks for industrial use have been found satisfactory, additional modifications are warranted to further improve the use of such equipment.

SUMMARY OF THE INVENTION

Accordingly, it is an object of the present invention to provide a pump jack which avoids the aforementioned problems of prior art devices.

It is another object of the present invention to provide a pump jack which ensures a secure riding up and down along the pump jack pole.

Yet another object of the present invention is to provide a pump jack with easily operated and safe pump jack operation.

Briefly, in accordance with the present invention, there is provided a pump jack for traveling up and down a pump jack pole. The pump jack includes a frame member which supports a lower and an upper shackle. The lower shackle includes a single U-shaped yoke member which is directly pivotally connected to the pump jack frame by a pivot axle, thereby eliminating a separate linkage U-shaped member. The upper shackle includes a U-shaped yoke member and a U-shaped linkage member. The forward gripping rod of the yoke member includes a spacer member which spaces the gripping rod from the pump jack pole as the upper shackle steps up along the pole.

In an embodiment, the spacer member is a freely rotatable roller mounted inwardly of the gripping rod of the upper shackle so that when the yoke member is released from gripping engagement from the pole, the roller rides along the surface of the pole and keeps the gripping rod spaced from the surface of the pole. This will then permit the upper shackle to be stepped up along the pole upon lifting of the pump arm.

In an embodiment of the invention, the freely rotatable roller is arranged on a plate member fixed to the yoke member of the upper shackle.

In an embodiment of the invention, the plate member is pivotable with respect to the yoke member and the plate member is spring-biased toward the pole. This arrangement permits the roller to adjust the upper shackle to different thicknesses of the poles.

In an embodiment of the invention, a release lever with a foot pedal is provided on the lower shackle to release the latter for downward movement along the pole.

The aforementioned objects, features, and advantages of the invention will, in part, be pointed out with particularity, and will, in part, become obvious from the following more detailed description of the invention, taken in conjunction with the accompanying drawings which form an integral part thereof.

BRIEF DESCRIPTION OF THE DRAWINGS

In the drawings.

In the various figures of the drawings, like reference character designate like parts.

DETAILED DESCRIPTION OF THE PREFERRED EMBODIMENTS

Figure 1:
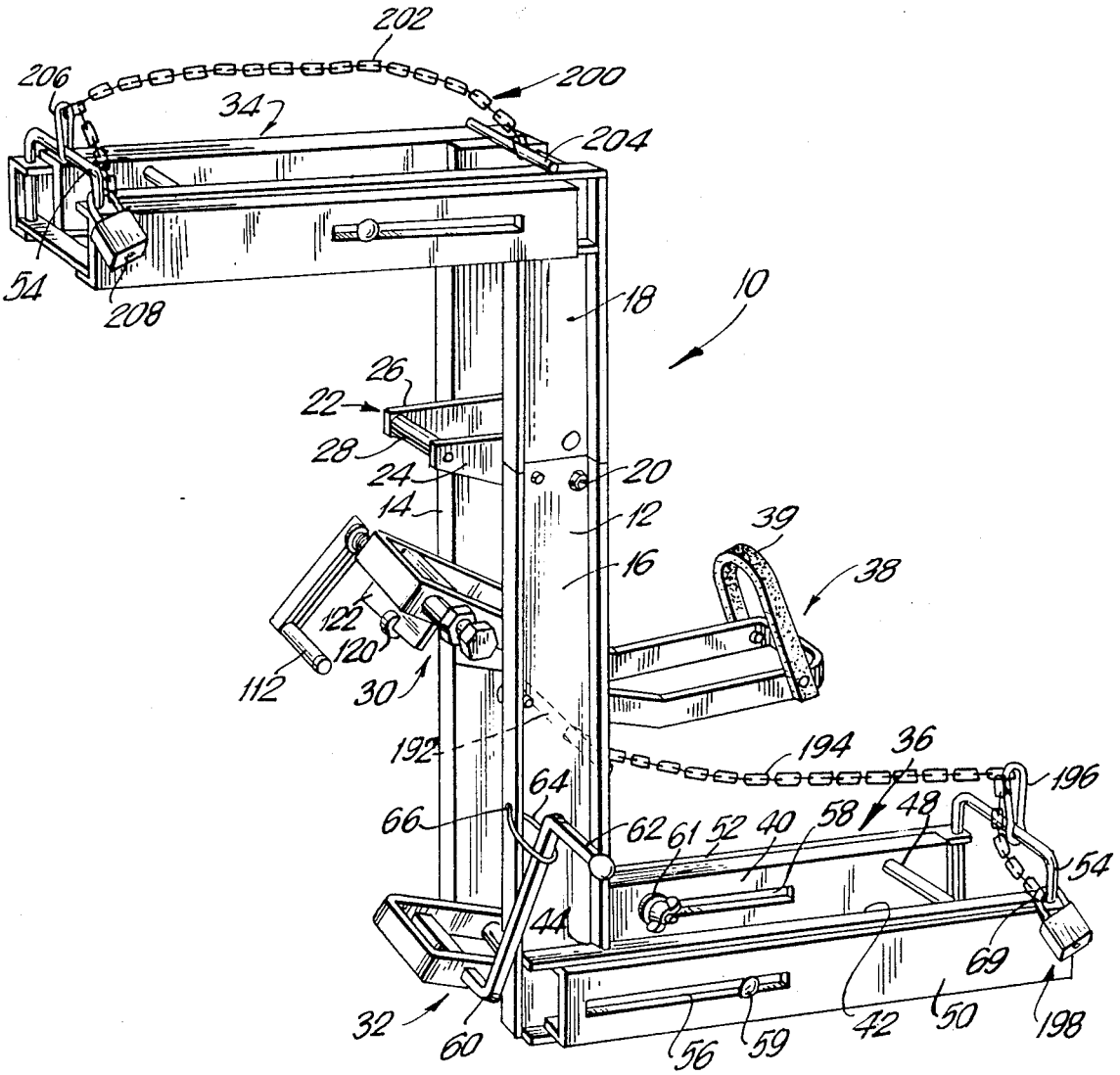
FIG. 1 is a perspective view of a pump jack according to the invention.

Referring now to FIG. 1, a pump jack generally designated at 10 comprises a frame member which straddles the pole (not shown) to permit upward and downward movement of the pump jack along the pole and includes two opposing pairs of vertical posts 12 and 14. The vertical posts are formed of substantially U-shaped channels spaced from each other. Each channel includes a lower section 16 and an upper section 18 which are bolted at 20 or otherwise rigidly connected to each other. A spacing member 22 is provided to space apart the opposing side walls of vertical posts 12 and 14. Spacing member 22 is formed of two side plates 24, 26 which are in turn spaced from each other by a roller 28. An additional roller between the rear ends of the side plates 24 and 26 can be also provided. Spacing member 22 straddles around the pole in order to maintain the pump jack vertical along the pole.

The pump jack 10 further comprises an upper shackle member 30, a lower shackle member 32, an upper support arm 34 and a lower support arm 36. The upper and lower support arms project horizontally away from the frame member 12, 14 in two opposite directions. A pump arm 38 provided with a loop foot pedal 39, as is known within the pump jack art and will nevertheless be explained in detail hereinafter, is arranged on the frame member to control the pumping action for stepping the pump jack upwardly along the pole.

The upper and lower support arms 34, 36 are substantially identical and each includes opposing pairs of U-shaped channels 40, 42 which can be fastened directly to the opposing vertical posts 12, 14. A notch 44 can be formed in each lower portion 16 of the vertical posts 12, 14 in order to accommodate the horizontal channels 40 and 42. Spacer rods 48 extend transversely between channels 40 and 42 to space them apart and hold them parallel one to another.

A further pair of U-shaped channels 50, 52 are inverted and slidably positioned within the recesses formed by the opposing channels 40 and 42. A U-shaped handle 54 interconnects outer channels 50 and 52 and serves to facilitate reciprocal sliding of the outer channels 50, 52 relative to the inner channels 40, 42.

A pair of elongated slots 56 are formed in the outer channels 52, 50 while a pair of corresponding slots 58 are formed in the inner channels 40, 42. Bolts 59 with wing nuts 61 pass through the aligned slots so as to lock the outer channels relative to the inner channels to adjust the projecting length of the support arm 36 or 34, respectively. Thereby either of the support arms 34, 36 can be extended outwardly or moved inwardly to allow for accommodation to different widths of scaffolding platforms to be placed on the support arms.

A release lever 60 is connected to the lower shackle member 32 to push the lower shackle member forward and away from a gripping relationship on the pole when the pump jack is to be lowered. Release lever 60 is terminated with a foot pedal 62 to facilitate pushing forward of the lower shackle member. With the lower shackle disengaging from the pole, and with the upper shackle engaging the pole, the handle 112 can be used to roll the pump jack down the pole. In a non-operative position, lever 60 with pedal 62 is secured to the lower section 16 of the vertical post 12 of the frame member by means of a wire 64 which extends through a hole 66 of the lower section 16. A belt or any other suitable means may be utilized in place of wire 64. This serves to limit the extent of movement of the lever 60.

The pump jack operates by alternate gripping of the pole by means of the upper and lower shackles. As the worker stands on the platform, his weight on the support arm 36 causes the lower shackle 32 to grip the pole. With his foot in the stirrup 39, the worker lifts the pump arm 38. This releases the upper shackle from gripping the pole and steps up the upper shackle along the pole while the frame of the pump jack remains stationery on the pole. The worker then pushes downward on the pump arm. This shifts his weight from the support arm 36 to the pump arm 38 thereby releasing the lower shackle from gripping the pole and now causing the upper shackle to grip the pole. Continued downward pushing of the pump arm now causes the pump jack frame to step upward along the pole, while the upper shackle remains fixed and gripping the pole.

Figure 2:
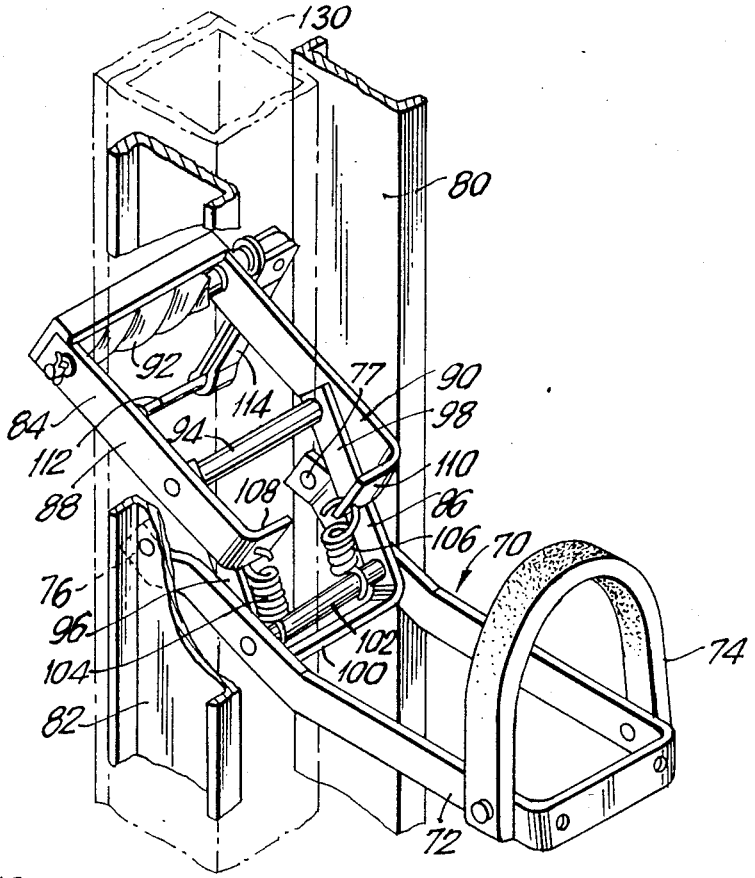
(PRIOR ART) FIG.2
FIG. 2 is an enlarged, partially cutaway, perspective view showing an upper shackle member of the prior art.

Referring now to FIG. 2, it will be seen that the upper shackle of the prior art arrangement includes a pump arm 70 formed of a substantially U-shaped member 72 having at its rearward distal end a stirrup 74 through which the foot of a worker could be placed. The forward distal ends of the U-shaped member 72 are pivotally connected by means of a pivot pins 76, 77 to side walls 80, 82 of the frame member of the pump jack.

The upper shackle further includes a U-shaped yoke member 84 and a U-shaped linkage member 86. The yoke member 84 includes two opposing side plates 88, 90, a gripping helical rod 92 at a forward end of the yoke member and a gripping roller 94 extending between the side plates 88 and 90. The linkage member 86 is formed of a U-shaped member which has two opposing side legs 96, 98 and a rear connecting plate 100. The linkage member 86 is pivotally connected to the pump arm 70 by means of a connecting bar 102. The yoke member 84 and the linkage member 86 are pivoted together about the gripping roller 94 which serves not only as a pivot about which the two parts of the upper shackle rotate with respect to each other but also for gripping the rear surface of the pole.

The spring biasing function between the yoke member and the linkage member in this prior art arrangement is fulfilled by means of tension springs 104, 106 spaced from each other and extending parallel to one another. Each spring 104, 106 is supported between a respective ear 108, 110 formed at the rear side of the yoke member 84 and the connecting rod 102. The gripping rod 94 is positioned intermediately along the length of the opposing side plates 88 and 90 of the yoke member. A handle 112 for rotating the helical rod 92 during downward movement of the pump jack is connected by means of a lever 114 to the outward end of the helical rod 92.

The springs 104, 106 provide a bracing on the rear end of the yoke member 84. During pumping of the pump arm 70 the springs pull down on the back end of the yoke member 84 to be sure that the yoke member 84 is sufficiently angled so that it will tightly grip the pole and the helical rod 92 will bite into the front surface of the pole to tightly engage the pole.

During lifting of the pump arm, the springs 104, 106 pull up on the rear end of the yoke member 84 to release the yoke member from gripping the pole and to keep the rod 92 in loose relationship with the front of the pole so the upper shackle can be stepped upwardly along the pole.

Figure 3:
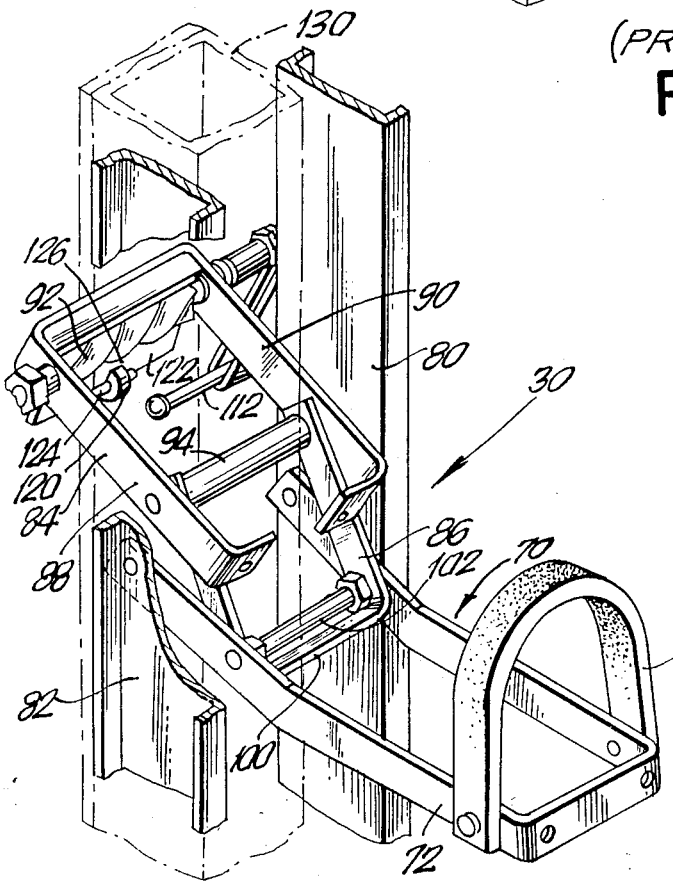
FIG. 3 is an enlarged, partially cutaway perspective view showing the upper shackle member with a roller according to the invention.
Figure 3A:
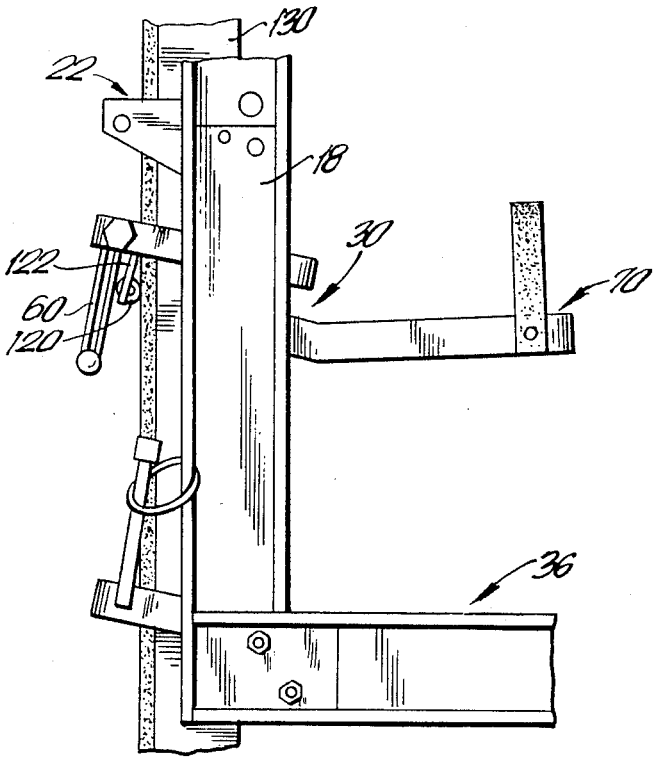
FIG. 3A is a side view showing a roller on a fixed plate in the engaged position with the surface of the pole.

FIGS. 3 and 3A illustrate the upper shackle 30 according to the present invention. The parts similar to those discussed in connection with FIG. 2 have the same reference numerals. In the upper shackle arrangement of this invention tension springs 104 and 106 for biasing the yoke member 84 relative to the linkage member 86 are eliminated. It has been found that when lowering the pump arm, the yoke member engages the pole even without the springs. In order to release the gripping of the pole and keep the rod 92 spaced from the pole when stepping up of the yoke member 84, a freely rotatable roller 120 is mounted on a plate member 122 fixed to or integral with the yoke member 84. Plate member 122 extends normal to the side plates 88, 90 of the yoke member 84 and moves with the yoke member 84 to bring freely rotatable roller 120 into and out of contact with the pole 130 as the angle of the yoke member 84 is changed with respect to the pole. As mentioned above the spring arrangement of the prior art upper shackle construction with the tight tension springs had required that a considerable force be used to overcome the springs when depressing the pump arm 70. Elimination of these springs, therefore requires less force and reduces exertion to pump the pump arm. Nevertheless, the gripping action is securely maintained even without the springs, and the release action causes the roller to contact the face of the pole and thereby permits the yoke member 84 to slide along the pole as it is stepped upward along the pole.

Roller 120 is freely rotated on a pivot or axle 124 and extends with its upper half into a recess 126 formed in the fixed plate member 122. For convenience, the roller 120 can be arranged on the yoke member 84 so that the inward part of roller 120 projects slightly inwardly of yoke member 84 farther or deeper than helical rod 92.

As best seen in FIG. 3A, in stepping up position of the upper shackle 30, roller 120 is in engagement or contact with pole 130 thus rolling along the surface of the pole as helical rod 92 is retained out of contact with the pole surface. In this manner roller 120 insures that the rod 92 will not grip the pole 130 and thereby permit the shackle to be stepped upwardly. On the other hand, when the rod 92 should engage the pole, the downward push on the pump rod and the pull by the linkage member 86 is sufficient to cause the shackle to increase its angle with respect to the pole, thereby pulling the roller 120 away from the pole and permitting the rod 92 to bite into the face of the pole.

Figure 4:
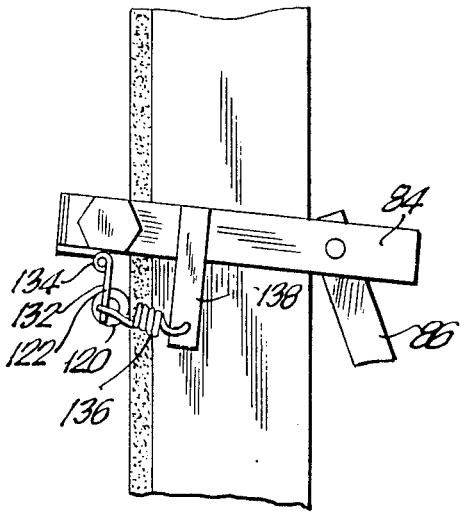
FIGS. 4 and 4A show the roller with a hinged plate and a spring according to a modified embodiment of the invention.
Figure 4A:
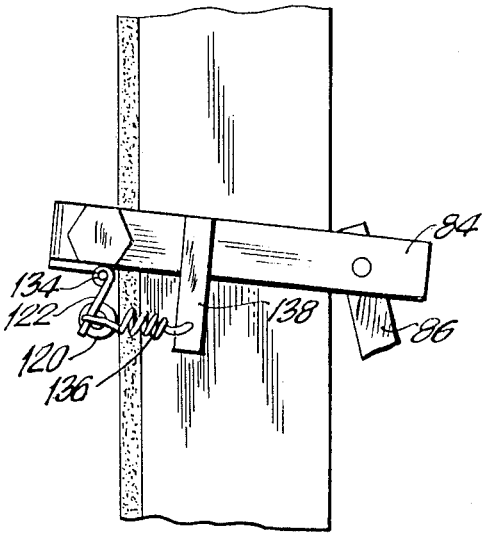

FIGS. 4 and **4*a* illustrate a modified embodiment of the freely rotatable roller 120. In place of the fixed plate member 122 roller 120 here is mounted on a pivotable plate member 132 which is pivoted about a pivot axle 134 fixed to the yoke member 84. A biasing tension spring 136 is provided between the plate member 132 and the end of a bar 138 fixed to the yoke member 84. Spring 136 is considerably weaker than springs 104, 106 utilized in the prior art arrangement and overcoming its force does not present any problem to an operator. Pivotable plate member 132 and tension spring 136 provide a self adjustment of roller 120 to difference thicknesses of the pole 130**.

Figure 5:
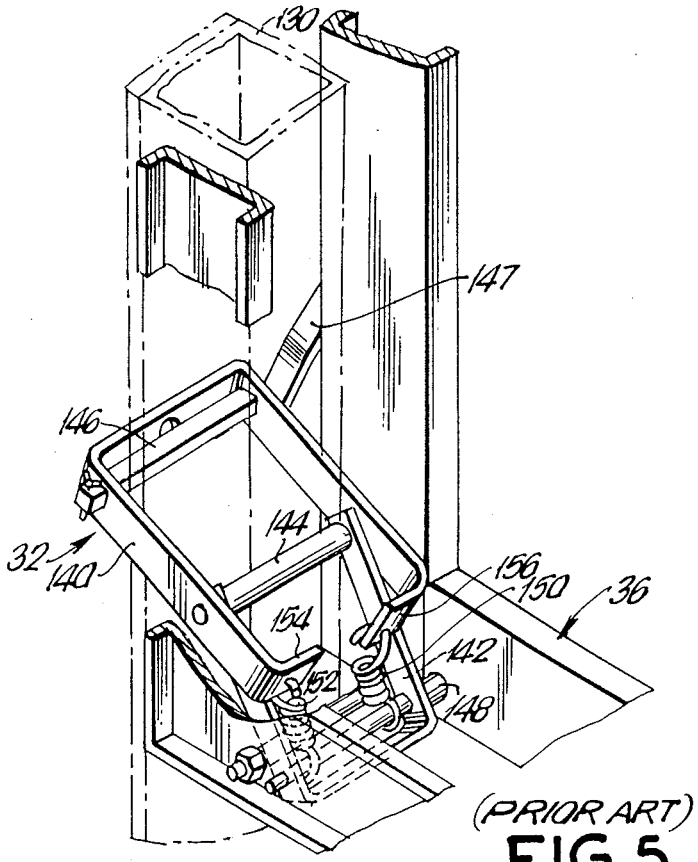
(PRIOR ART) FIG.5
FIG. 5 is an enlarged, partially cutaway, perspective view showing lower shackle member of the prior art.

FIG. 5 shows a lower shackle of the prior art. The lower shackle 32 includes a U-shaped yoke member 140 and a U-shaped linkage member 142. The yoke member and the linkage member are pivoted together along a pivot rod 144 which, at the same time, serves as a rear gripping rod for engaging the rear side of pole 130. A forward gripping rod 146 shown as a square rod to provide a grip by means of one of the corner edges, is provided in a known manner for gripping the front side of pole 130. The distal end of the linkage member 142 is pivotally connected to the support arm 36 (FIG. 1) by a connecting rod 148. Two tension springs 150, 152 extending parallel to each other between ears 154, 156 of the yoke member 140 and the connecting rod 148 are provided for spring biasing the lower end of yoke member 140 to keep the rear end of the yoke member downward so that the yoke member will remain at an angle and when weight is put on the lower support arm 36 the front gripping rod 146 will bite into the face of the pole. The front gripping rod is released from gripping the pole when the worker's weight shifts to the pump arm. At that time the frame can be stepped upward along the pole.

When it is desired to descent the pole, the weight of the worker is on the support arm 36. The lower shackle would then tend to grip the pole. Accordingly, the foot release lever 147 is used to move the forward edge of the lower shackle slightly downward so the gripping rod 146 is out of engagement of the face of the pole. The handle 112 (FIG. 1) is then used to roll the rod of the upper shackle downward to descend.

Because of the double U-arrangement between the yoke member 140 and the linkage member 142, with only the member 142 pivoted to the frame, a scissor action occurs between the two U-shaped members. As a result, a large amount of force is regained to depress the foot release 147 and even then only a small amount of spacing is achieved between the gripping rod 146 and the face of the pole.

Additionally, because of the double U-arrangement, when releasing the lower shackle, the shackle moves in an arcuate path. This causes the pump jack frame to arcuate whereby a momentary sensation of the jack dropping downward results.

Figure 6:
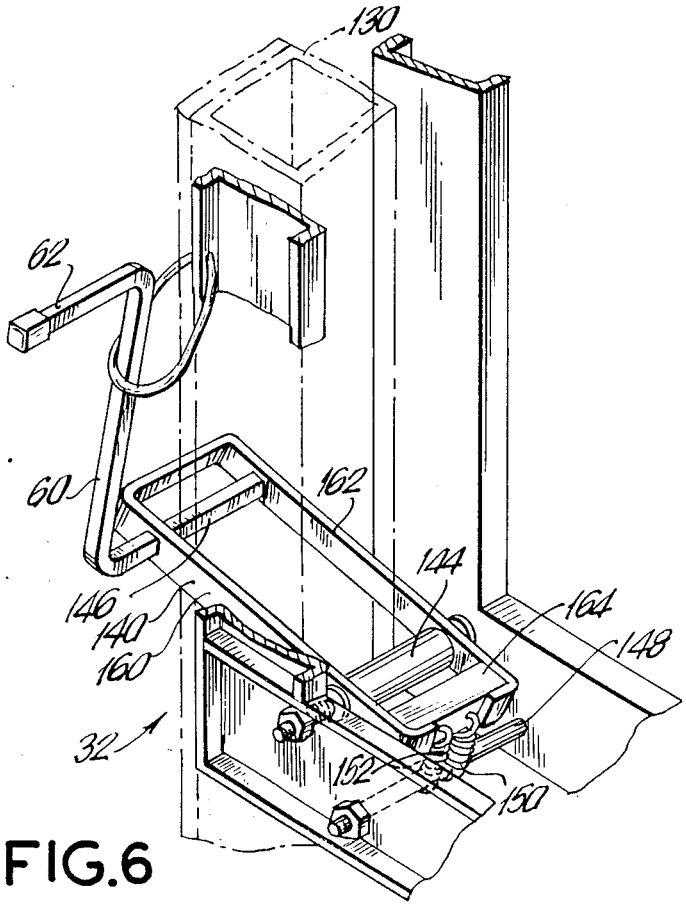
FIG. 6 is an enlarged, partially cutaway perspective view, showing a lower shackle member according to the present invention.

FIG. 6 shows an improved construction of the lower shackle according to the present invention. Here, in order to avoid the leverage problem caused by the two U-shaped members 140 and 142 in the prior art arrangement of the lower shackle, one of the U-shaped members, namely the linkage member is omitted. Yoke member 140 is also of U-shaped configuration similarly to the prior art arrangement and has inserted between its side plates 160, 162 two gripping members 144 and 146, of which the forward gripping rod 146 of a substantially rectangular cross-section is connected, at its end extending outwardly of the side plate 160, to the foot release lever 60 terminated with the handle 62 described in connection with FIG. 1. The rearward gripping rod 144, however is formed not only as a rear gripping member but now also serves as a pivot axle for the yoke member 140 pivotable relative to the frame member of the pump jack. Thus, now there is only one U-shaped member, and that member is directly pivoted to the frame.

Springs 150, 152 can be connected between the ears of the yoke member 140 and connecting rod 148 or, as shown in the exemplified embodiment, between a bar 164 rigidly connected to the side plates 160, 162 of the yoke member and connecting rod 148. Release lever 60, as described above, is provided to release the lower shackle 32 from its engagement onto the pump jack pole in order to permit rolling down of the pump jack along the pole. The outwardly inverted foot pedal 62 is adapted to permit the operator to use his foot in order to release the lower shackle from its gripping engagement with the pole.

By using the arrangement of FIG. 6, the pressure on the lever 62 will directly apply to the pivoting of the yoke member 140. This will increase the space movement of the rod 146 from the face of the pole. Also, the movement of the lower shackle is no longer arcuate whereby the slight drop which was heretofore experienced with the prior art will no longer occur.

Figure 7:
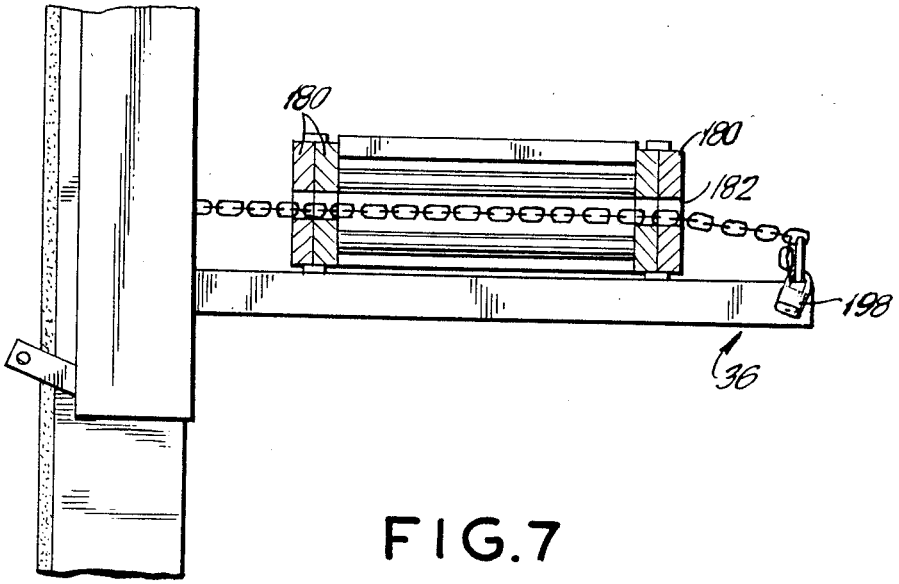
FIG. 7 is a side view, partially in section, of the pump jack, showing a coupling arrangement for staging sections.
Figure 8:
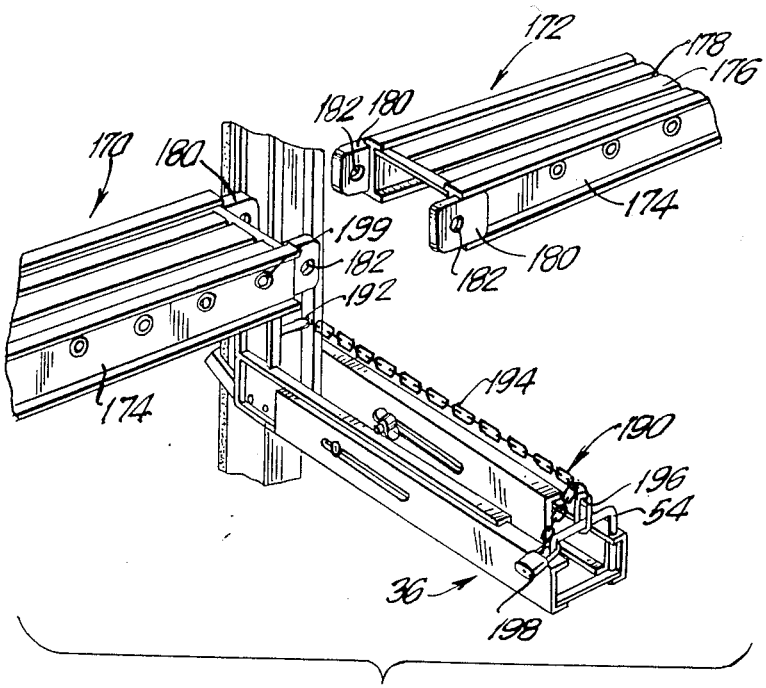
FIG. 8 is an exploded perspective view of the arrangement for coupling staging sections of a scaffolding platform.

FIGS. 7 and 8 illustrate an interconnecting arrangement for coupling elongated staging sections to the support arms. The coupling arrangement for each of support arms 34 and 36 is also shown in FIG. 1. Each support arm typically supports at least one elongated staging sections and often two adjacent sections 170, 172. Each of the staging sections 170, 172 is formed of an opposing pair of I-beams 174 which support a platform top 176. The latter is typically formed of aluminum strips with spaces 178 formed between the strips. The I-beams 174 of each platform have at their ends facing each other, side plates 180 each of which projects outwardly from the edge of the staging section. Each side plate 180 is secured to the respective I-beam by rivets, welding or any other suitable means. A bore 182 is formed in the forwardly extending section of each side plate 180. Side plates 180 of the staging section 170 are provided laterally inwardly of I-beams 174 whereas the side plates of the staging section 170 are attached to the outer walls of I-beams 174.

The pair of side plates 180 of staging section 172 are arranged so that bores 182 formed therethrough are aligned. Furthermore, the bores 182 in the side plates of the adjacent staging section 170 are also aligned and arranged such that as they are placed adjacent to the section 172, the bores 182 of all four side plates 180 will be coaligned when both staging sections 170 and 172 are placed onto the support arm 36. Since the side plates 180 at the end of staging section 172 are placed on the inner side of the I-beams 174 the inside plates 180 on staging section 170 will fit inbetween the outer side plates 180 of the staging section 172 when the two staging sections are brought together.

The coupling arrangement for interconnecting the staging sections 170, 172 and securing them to the support arm 36 is constructed to permit an angular displacement of the respective staging section when the pump jack is stepped up the pump jack pole. The coupling arrangement generally designated at 190 is comprised of a steel rod 192 rigidly secured, for example, by welding, at its opposed ends, between the inner walls of vertical posts 12 and 14 of the frame member of the pump jack. An end chain link of a chain 194 slides on the rod 192. When staging sections 170 and 172 ar placed on support arm 36 so that all four bores 182 of side plates 180 are co-aligned, chain 194 is inserted through these co-aligned bores as shown in FIG. 7 to hold the two staging sections together. Alternatively, chain 194 may be inserted through the hollow sleeves of rungs 199 of the staging sections. Chain 194 in the coupled position extends substantially parallel to support arm 36. The coupling arrangement further includes a snap-hook 196, also shown in FIG. 1, which is snapped at its ring-shaped or loop-shaped end on the handle 54 of the lower support arm 36. The hook end of the snap-hook 196 can be hooked to any of the intermediate links of chain 194. The free end link of chain 194 can be locked to the handle 54 and/or additionally secured to the same by a latch 198 the loop of which encircles the handle 54 not only to secure the staging sections to the support arm 36 but also to secure the inner and outer channels 40, 50 of support arm 36 to each other. The sliding motion of the end chain link on rod 192 facilitates the insertion of chain 194 into rungs 199 or bores 182 of the staging sections 170, 172.

With reference to FIG. 1, it will be seen that the upper support arm 34 is provided with a security arrangement 200 which is similar to that of the lower support arm 36. A chain 202 extending substantially in parallel with support arm 34 has its one end link slidably positioned on a steel rod 204 rigidly secured at its two opposing ends, for example, by welding to a staging platform or workbench (not shown). Chain 202 is inserted into the bores or rungs of the staging platform to be placed on support arm 34. A snap-hook 206 installed on handle 54 of the upper support arm is hooked to any desired intermediate link of chain 202. The chain may be coupled at its free end link to a latch 208 which can also secure two slidable channels of the upper support against disengagement from each other.

The above-described chain and snap-hook coupling arrangement provided for at least the lower support arm is much easier to install and use than the safety lock comprised of two telescopic bars described in applicant's Pat. No. 4,499,967.

In addition to coupling the staging sections to each other and/or to the respective support arm so as to permit an angular displacement of the staging section when the pump jack is stepped up the pole, the coupling arrangement according to the present invention is an anti-theft device and a back-up safety system against disengagement of the sliding channels of the support arm from each other.

There has been disclosed heretofore the best embodiment of the invention presently contemplated. However, it is to be understood that various changes and modifications may be made thereto without departing from the spirit of the invention.

What is claimed is:

1. A pump jack arranged for traveling up and down a pole, comprising:

a frame member having a support arm;

a lower shackle member and an upper shackle member supported by said frame member;

a pump arm pivotally connected to said frame member for causing, in conjunction with the support arm, said lower and upper shackle members to alternately grip the pole with the non-gripping shackle member being stepped upwardly along the pole;

said upper shackle member and said lower shackle member each including a forward and a rearward gripping member for engaging a front and a rear surface, respectively, of the pole during alternating gripping the pole;

said upper shackle member further including spacing means mounted on said upper shackle so as to be brought into and out of contact with the front surface of the pole and to thereby enable spacing of the forward gripping member of the upper shackle member from the front surface of the pole when said upper shackle member is non-gripping, to thereby facilitate upward stepping of the upper shackle member.

2. A pump jack as in claim 1, wherein said spacing means comprises a freely rotatable roller.

3. A pump jack arranged for traveling up and down a pole, comprising:

a frame member having a support arm;

a lower shackle member and an upper shackle member supported by said frame member;

a pump arm pivotally connected to said frame member for causing, in conjunction with the support arm, said lower and upper shackle members to alternately grip the pole with the non-gripping shackle member being stepped upwardly along the pole;

said upper shackle member and said lower shackle member each including a forward and a rearward gripping member for engaging a front and a rear surface, respectively, of the pole during alternating gripping the pole;

said upper shackle member further including spacing means mounted on said upper shackle for spacing the forward gripping member of the upper shackle member from the front surface of the pole when said upper shackle member is non-gripping, to thereby facilitate upward stepping of the upper shackle member;

said spacing means including a freely rotatable roller, wherein said upper s hackle member comprises a U-shaped yoke operatively connected to and pivoted by said pump arm, said freely rotatable roller being mounted on said yoke and adjacent said forward gripping member of said upper shackle member, and being brought into and out of contact with the front surface of the pole by the angular position of the yoke with respect to the pole.

4. A pump jack as in claim 3, wherein said U-shaped yoke has a fixed plate rigidly connected thereto, said plate carrying said roller.

5. A pump jack as in claim 4, wherein said plate includes a roller axle rigidly connected therewith, said roller being rotatable on said roller axle.

6. A pump jack as in claim 5, wherein said plate has a recess, said roller extending into said recess, which permits free rotation of said roller.

7. A pump jack as in claim 5, wherein said U-shaped yoke includes two parallel opposing side plates, said fixed plate extending substantially normal to said side plates.

8. A pump jack as in claim 3, wherein said U-shaped yoke includes a mounting member for supporting said freely rotatable roller so that said roller depends from said yoke and is positioned lower than said forward gripping member of said upper shackle member.

9. A pump jack as in claim 8, wherein said mounting member is a plate rigidly connected to said U-shaped yoke.

10. A pump jack as in claim 8, wherein said mounting member is a plate pivotally connected to said U-shaped yoke.

11. A pump jack as in claim 10, further including spring means for biasing said mounting member with said roller thereon toward the pole to provide for self-adjustment of said roller to different thicknesses of the pole.

12. A pump jack as in claim 11, wherein said yoke has a transverse bar, said spring means extending between said mounting member and said transverse bar.

13. A pump jack as in claim 1, wherein said upper shackle member comprises a yoke member for fitting around a pole, and a linkage member, said linkage member being pivotally coupled to said pump arm and also pivoted to said yoke member and characterized by the absence of biasing springs between the yoke member and the linkage member.

14. A pump jack as in claim 1, wherein said lower shackle member comprises a single substantially U-shaped member supporting thereon said forward and rearward gripping members.

15. A pump jack as in claim 14, and comprising pivot means for pivoting said U-shaped member to said frame member.

16. A pump jack as in claim 15, wherein said rearward gripping member also serves as said pivot means.

17. A pump jack as in claim 14, and further comprising release means including a pivotable lever connected to said forward gripping member and adapted to shift the latter away from the pole.

18. A pump jack as in claim 17, wherein said release means further includes a foot pedal rigidly connected to said lever.

19. A pump jack as in claim 14, and further comprising spring means for biasing a rear side of said U-shaped member to said frame member.

20. A pump jack as in claim 17, and further including means for securing said lever to said frame member, when said lever is in a non-operative position.

21. A pump jack arranged for traveling up and down a pole, comprising:

a frame member, weight support members including an upper pump arm pivotally coupled to said frame member and a support arm fixedly projecting from said frame member, upper and lower shackle members pivotally connected to respective weight support members, said pump arm causing said shackle members to alternately grip the pole with the non-gripping shackle member being stepped upwardly along the pole, said lower shackle member including a single yoke member for encircling the pole and being directly pivotally connected to and supported on the support arm, said single yoke member having a pivot axle for pivoting relative to said support arm, said pivot axle being spaced from both ends of said yoke member.

22. A pump jack as in claim 21, wherein said lower shackle includes spring means mounted between said single yoke member and said support arm.

23. A pump jack comprising:

a frame member;

at least a lower support arm connected to said frame member for supporting lower staging means having a hollow transversal rung;

a pump jack mechanism arranged for travelling up and down a pole, said pump jack mechanism including a lower shackle member and an upper shackle member supported by said frame member, a pump arm pivotally connected to said frame member for causing, in conjunction with the support arm, said lower and upper shackle members to alternately grip the pole with the non-gripping shackle member being stepped upwardly along the pole, said upper shackle member and said lower shackle member each including a forward and a rearward gripping member for engaging a front and a rear surface, respectively, of the pole during alternating gripping the pole; and safety means removably coupled in parallel along said support arm for passing through the rung on the staging to secure the staging onto the support arm, said safety means having one end connected to said frame member.

24. A pump jack as in claim 23, wherein said safety means includes chain means having one end connected to said frame member and another end for removably latching to said support arm.

25. A pump jack as in claim 24, wherein said safety means further includes a snap hook secured to said support arm and adapted to be hooked to said chain means.

26. A pump jack as in claim 25, wherein said safety means further comprises locking means for locking said another end of said chain means to said support arm.

27. A pump jack as in claim 25, wherein said safety means further comprises a rod secured to said frame member, said one end of said chain means being permanently secured to said rod.

28. A pump jack as in claim 1, wherein said lower shackle member includes a single yoke member for encircling the pole and being directly pivotally connected to and supported on the support arm.

29. A pump jack as in claim 1, and further comprising safety means removably coupled in parallel along said support arm and having one end secured to said frame member and another end removably-securable to a distal end of said support arm.

* * * * *